US005184813A

United States Patent [19]

Schwitzky et al.

[11] Patent Number: 5,184,813

[45] Date of Patent: Feb. 9, 1993

[54] SEPARATING JET BLAST AIR CONTROL ASSEMBLY

[75] Inventors: Volkmar R. Schwitzky, Oberdurrbach; Jurgen A. Stiel, Ostheim, both of Fed. Rep. of Germany

[73] Assignee: Koenig & Bauer Aktiengesellschaft, Wurzburg, Fed. Rep. of Germany

[21] Appl. No.: 848,366

[22] Filed: Mar. 9, 1992

[30] Foreign Application Priority Data

Mar. 13, 1991 [DE] Fed. Rep. of Germany ..... 4108002
Feb. 1, 1992 [DE] Fed. Rep. of Germany ..... 4202861

[51] Int. Cl.[5] ..... B65H 3/48

[52] U.S. Cl. ..... 271/98; 271/105; 271/108

[58] Field of Search ..... 271/97, 98, 105, 108

[56] References Cited

U.S. PATENT DOCUMENTS 4,662,622 5/1987 Wimmer ..... 271/98 X
5,088,713 2/1992 Hayashi ..... 271/98 X

FOREIGN PATENT DOCUMENTS 2643381 9/1976 Fed. Rep. of Germany .
7711340 9/1977 Fed. Rep. of Germany .

*Primary Examiner*—Richard A. Schacher
*Attorney, Agent, or Firm*—Jones, Tullar & Cooper

[57] ABSTRACT

A separating jet blast air control assembly utilizes a regulating valve to control the amount of compressed air supplied to separating and fanning blowers of a sheet feeder. A valve disc that dumps excess compressed air is biased against a valve seat by a biasing spring. The force applied by the biasing spring is adjustable in accordance with an output from a controller in response to production speed, sheet characteristics and other variables.

9 Claims, 5 Drawing Sheets

SEPARATING JET BLAST AIR CONTROL ASSEMBLY

FIELD OF THE INVENTION

The present invention is directed generally to a separating jet blast air control assembly. More particularly, the present invention is directed to a separating jet blast air control assembly in a sheet feeder. Most specifically, the present invention is directed to a separating jet blast air control assembly for a sheet feeder in a sheet fed rotary printing press. Blast air is supplied from an air compressor to the separating blowers and fanning blowers. The air compressor operates at a constant pressure and volume. A regulating valve assembly in accordance with the present invention is positioned between the air compressor and the separating blowers and fanning blowers. An adjustable valve dumps any unneeded portion of the air supplied by the air compressor in accordance with the setting of the regulating valve assembly.

DESCRIPTION OF THE PRIOR ART

Sheet feeders are typically utilized in sheet fed rotary printing machines and in other similar devices to supply a plurality of sheets, as a stream of individual sheets, from a sheet stack to the rotary printing machine. It is usual to position one or more separating blowers and fanning blowers adjacent the upper portion of the sheet stack so that the uppermost sheet or sheets in the stack can be readily picked off the top of the sheet stack and sent through the sheet feeder to the sheet fed rotary printing machine. Since the type and weight of the sheets in the sheet stack will vary, and since the speed with which the sheets are being removed from the sheet stack will also vary, it is generally known to utilize various pressure regulators to supply the air under pressure to the fanning and separating blowers at a constant, preset level. This level depends, as indicated above, on the kind and nature of the material to be printed.

One type of pressure regulator that is useable for this purpose is described in the German utility model No. 7711340. In this pressure regulator, the excess air supplied by the air compressor but not needed by the separating or fanning blowers is dumped into the atmosphere by a valve. This valve utilizes a valve disc which is lifted off a cooperating valve seat against an adjustable spring force. Depending on the setting of the valve assembly, air pressure above a needed level will unseat the valve disc so that the excess air will be dumped to the atmosphere. This type of pressure regulator does not allow the regulation of a varying air pressure requirement which will occur when the working speed of the printing machine, and thus the working speed of the sheet feeder is changed. This is due to the fact that there is no coupling or communication between the pressure regulator and the printing machine. It is thus usual in these prior art devices to provide a throttle valve subsequent to the pressure regulator to allow there to be accomplished a changed requirement for blast air in case of a speed change of the sheet fed rotary press.

In the German patent specification No. 2,643,381 there is shown a controllable throttle valve for controlling and measuring the start up blast air supplied to a sheet separating device of a sheet feeder. A slide valve is connected through an air inlet opening with a source of air under pressure. The slide valve is also provided with an air outlet opening that is connected with the sheet separating device, and with an air outlet that discharges unneeded air to atmosphere. This air outlet to atmosphere can be regulated up or down by means of a control element in dependance on the machine speed during acceleration or slowing down of the sheet feeder. The control device is provided as a rotatably supported plug valve whose diameter is provided with a diametrically extending borehole. This borehole is in axial alignment with the air inlet opening when the preset final speed of the sheet feeding device is attained and is arranged with the air outlet opening which is diametrically opposite to the air inlet opening so that the air will be supplied to the slot separating device.

This controllable throttle valve always has to be adjusted since the volume flow of compressed air is dependant on the cross section of the compressed air using separation blowers and fanning blowers. This cross section changes as the fanning blowers and separating blowers are operated in a cyclic manner, which means alternatively, with blast air. This cyclical operation results in a pulsating air consumption. This pulsating air consumption has a detrimental effect on the fanning blowers which are alternatively provided with too little and then with too much blast air. This results in either no fanning being provided or with too strong a fanning effect being provided. In addition, the variation in the cross section of one blast jet effects the blast air supplied to the other jets so that a manual readjustment of the control valve becomes necessary.

It will be apparent that a need exists for a separating jet blast air control assembly which overcomes the limitation of the prior art devices. The separating jet blast air control assembly of the present invention provides such a device and is a significant improvement over the prior art devices.

SUMMARY OF THE INVENTION

It is an object of the present invention to provide a separating jet blast air control assembly.

Another object of the present invention is to provide a separating jet blast air control assembly for a sheet feeder.

A further object of the present invention is to provide a separating jet blast air control assembly for a sheet feeder of a sheet fed rotary printing machine.

Still another object of the present invention is to provide a separating jet blast air control assembly having a motor operated regulating valve assembly.

Yet a further object of the present invention is to provide a separating jet blast air control assembly having means to control the blast air quantity in response to the speed of the sheet feeder.

Even still another object of the present invention is to provide a separating jet blast air control assembly having means to control the blast air quantity in response to the weight of the sheets or other print carrier.

As will be discussed in greater detail in the description of the preferred embodiment, which is set forth subsequently, the separating jet blast air control assembly in accordance with the present invention utilizes a regulating valve assembly that is interposed between the source of compressed air and the separating blowers and fanning blowers. The regulating valve assembly is provided with a valve disc that is biased closing by an adjustable spring. It opens against the adjustable spring bias to discharge excess compressed air to atmosphere. The spring bias can be set both manually and by a motor. A computer is used to receive data on such variables as the weight of the print carrier being fed and the speed of operator of the sheet feeder. A plurality of charts can also be used to ascertain the portion of maximum available compressed air that will be needed for a certain production speed and print carrier weight. The motor in the regulating valve assembly can then be operated to correctly set the spring bias against which the blast air spring biased valve operates so that the appropriate amount of excess air, if any, will be discharged to atmosphere.

The separating jet blast air control assembly in accordance with the present invention allows the regulation of the amount of air flow supplied to the separating blowers and the fanning blowers in accordance with the weight and nature of the sheets or other print carrier being fed and in accordance with the speed of operation of the sheet feeding device. Once the required operating data, such as the weight of the sheets and the speed of operation has been supplied to a suitable control computer through a key board or the like, the regulating valve can be set to unseat its spring biased air blast valve at the necessary air pressure. This regulating valve assembly then overcomes the limitations of the prior art device and eliminates the pulsating air flows and previously required manual resettings of the regulating valve that were common in the prior art devices. The separating jet blast air control assembly of the present invention also accommodates for a misadjustment of single valves as was the case in the prior art.

The control assembly includes a computer which is connected to a keyboard or other input device for supplying data to the computer concerning the weight of the sheets which are to be printed. Also stored in the computer is data relating to characteristic curves for different sheet weights, relating the air flow volume required for different production speeds. This data can be in the form of a function for each sheet weight, or can be in the form of discrete values. The computer receives signals from a speed sensor connected to the sheet feeder, and from a pressure sensor in the compressed air flow line, and produces an output signal based on the characteristic curves. This output signal is supplied to the regulating valve drive motor to establish the valve setting which will provide the required air flow.

The separating jet blast air control assembly of the present invention overcomes the limitations of the prior art devices. It provides automatic, effective control of the amount of blast air supplied to the separating blowers and the fanning blowers and is a substantial advance in the art.

BRIEF DESCRIPTION OF THE DRAWINGS

While the novel features of the separating jet blast air control assembly in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
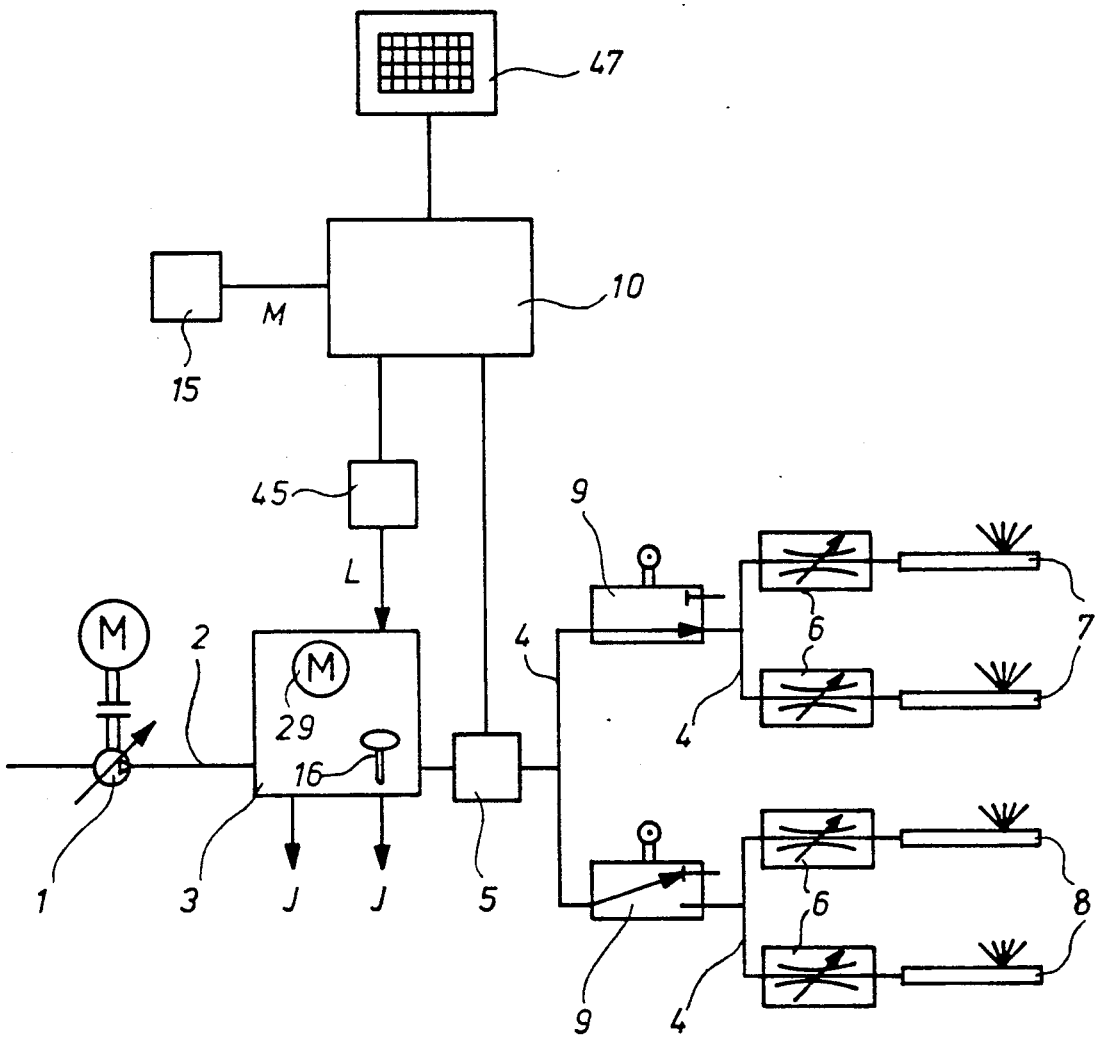
FIG. 1 is a schematic depiction of a separating jet blast air control assembly in accordance with the present invention.

Referring initially to FIG. 1, there may be seen a somewhat schematic depiction of the separating jet air blast control assembly in accordance with the present invention. A suitable compressed air generator, generally at 1, is joined by a connecting conduit or tube 2 with a regulating valve assembly 3 in accordance with the present invention. This regulating valve assembly 3 is connected through additional suitable tubes or conduits 4 and throttle valves 6 with separating blowers 7 and with fanning blowers 8. As may be seen most clearly in FIGS. 4 and 5, these separating and fanning blowers, 7 and 8 respectively, are part of a sheet feeder 38 of a sheet fed rotary printing press 37. A control valve 9 is positioned in each flow line 4 between the regulating valve 3 and each of the separating blowers and the fanning blowers. These control valves 9 are operated in a generally known manner to alternate the flow of compressed air between the separating blowers 7 and the fanning blowers 8.

Referring again to FIG. 1, there may be seen a machine control desk and integrated computer, generally at 10. The computer is connected to a key board 47 that is useable to supply characteristic curve data to the computer relating the weight of the print carrier or sheets that are to be printed on to the production speed of the machine and to the air pressures required for different speeds. A pressure sensor 5, which is located in the compressed air flow line 4 between the regulating valve 3 and the control valves 9, is also connected as an input to the computer. Further, a speed sensor 15, which provides an input M in the form of data regarding the speed of operation of the sheet feeder, is also connected as an input to the computer 10. The output from the computer is useable to operate the regulating valve 3, as will be discussed shortly.

Figure 2:
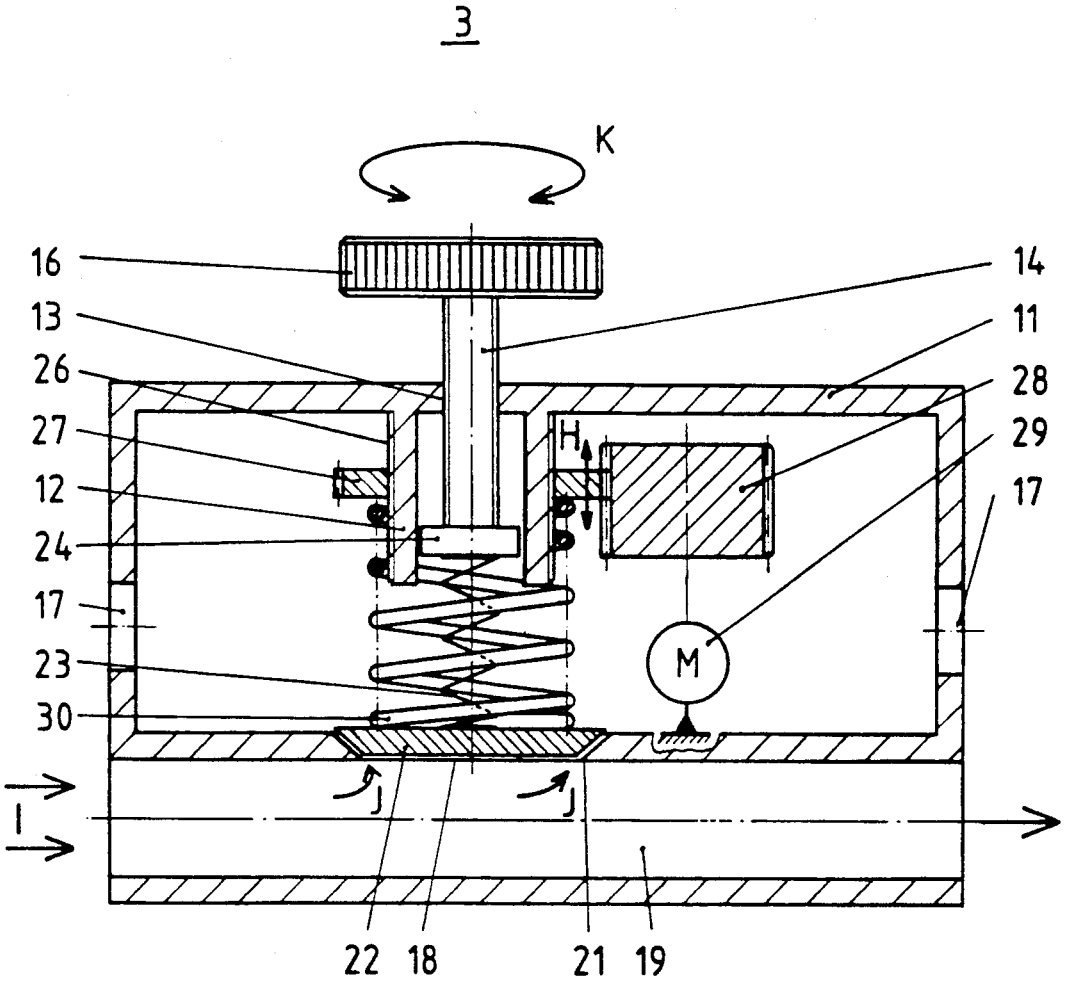
FIG. 2 is a schematic depiction, partly in cross-section, of a first preferred embodiment of a regulating valve for the present invention.

Turning now to FIG. 2, there may be seen generally at 3 a first preferred embodiment of a regulating valve in accordance with the present invention. The regulating valve 3 includes a housing 11 that has an inwardly directed sleeve 12 that extends down from an upper cover of the housing 11. A central tapped hole 13 is placed in the upper cover of the housing 11 in axial alignment with the sleeve 12. A threaded spindle 14 passes through the tapped hole 13 and is located within, and is rotatable with respect to the sleeve 12. A handwheel 16 is secured to the outer end of the threaded spindle 14 and a spring seat 24 is attached to the inner end of the spindle 14.

A pair of oppositely spaced compressed air exhaust openings 17 are provided in side walls of the housing 11.

The bottom portion of the housing 11 is formed as a blast air duct 19. This duct 19 receives compressed air from the compressed air generator 1 and directs it to the separating blowers 7 and fanning blowers 8. An air supply opening 18 selectively removes excess compressed air from the blast air duct 19 and allows this air to be dumped or exhausted through the exhaust openings 17 in the housing 11. It will be understood that the dumped compressed air can be exhausted through the exhaust openings 17 to atmosphere or to suitable sound absorbing devices so that the sound of the dumped excess compressed air does not exceed noise standards.

Air supply opening 18 has a chamfered valve seat 21, which is closed by means of a valve disc 22 that can be forced open against the force of a first worm spring 23. The first worm spring 23 is arranged between the valve disc 22 and the spring seat 24 which is attached to the inner end of the threaded spindle 14. The sleeve 12 of the housing 11 has an exterior thread 26, on which a first toothed gear wheel 27 is threadably carried. The toothed gear wheel 27 is in gear tooth engagement with a second toothed wheel 28. This second toothed wheel 28 is driven by a suitable reversible electric motor 29. Rotation of the motor 29 will thus cause the toothed wheel 27 to move up or down along the threaded sleeve 12, as indicated by the arrow H in FIG. 2.

As can also be seen in FIG. 2, the first toothed wheel 27 acts as an adjustable upper spring stop for a second coil spring 30 which is larger than, and concentric with the inner coil spring 23. Thus rotation of the motor 29 will effect a change in the spring force applied by the second coil spring 30 against the valve disc 22 in the air supply opening A greater spring force applied by second coil spring 30 will result in less excess compressed air being able to pass through air supply opening 18 and out through the exhaust openings 17.

Figure 3:
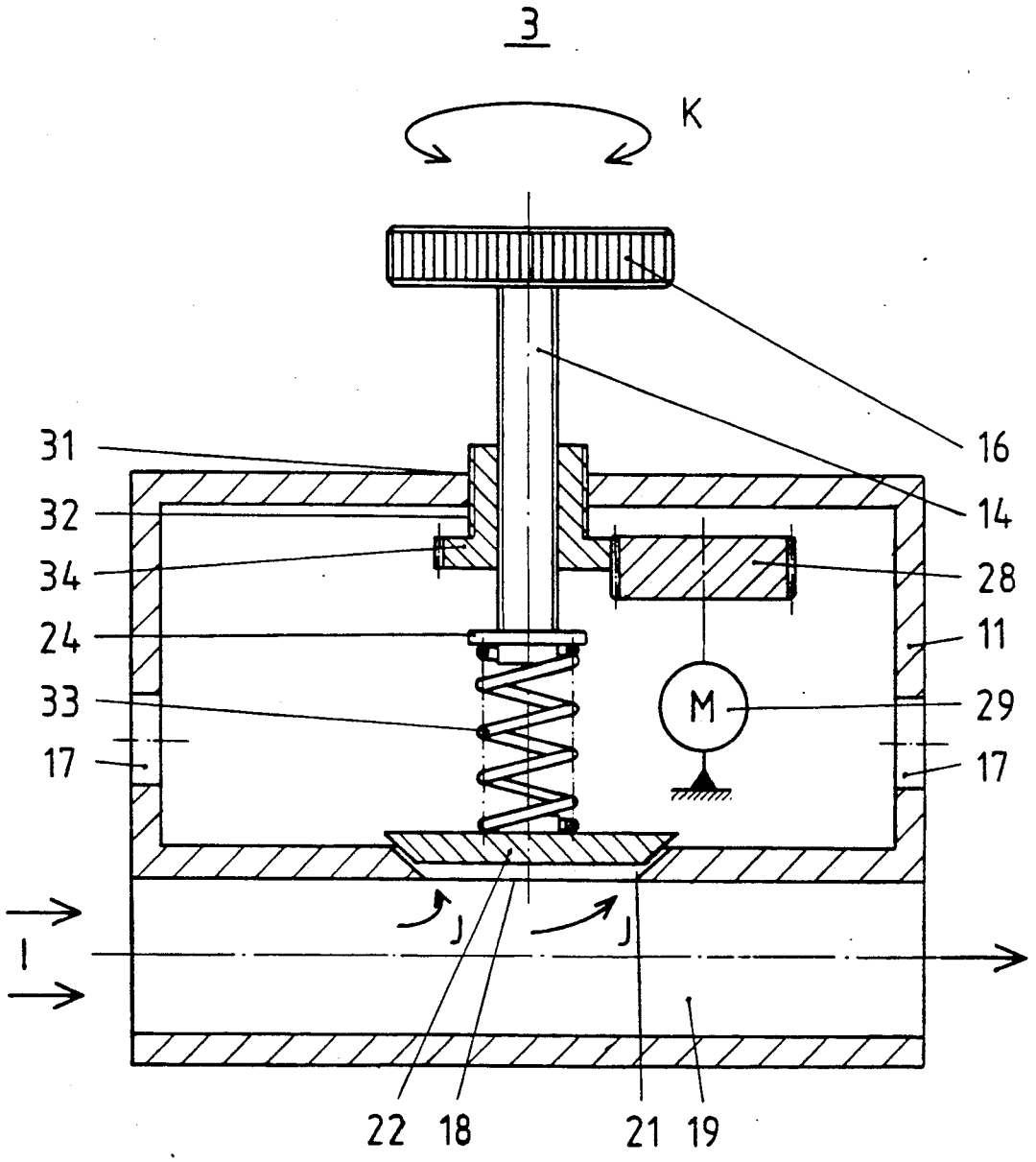
FIG. 3 is a schematic depiction, partly in cross-section, of a second preferred embodiment of a regulating valve.

A second embodiment of a regulating valve in accordance with the present invention is shown generally at 3 in FIG. 3. In this embodiment, the upper of the cover 11 has a threaded tap hole 31 which receives an externally and internally threaded bushing 32. This threaded bushing 32 receives the threaded spindle 14. The bushing 32 has an toothed wheel 34 on its end which is disposed within the housing 11. This toothed wheel 34 is in engagement with a toothed wheel 28 that is driven for rotation by motor 29. Thus as toothed wheel 28 is rotated by motor 29, it causes the toothed wheel 34 and its associated threaded bushing 32 to rotate. The rotation of the bushing 32 in the tap hole 31 raises or lowers the spindle 14 with respect to the valve disc 22. A spring seat 24 at the inner end of the spindle 14 is thus caused to move up or down with respect to valve disc 22 and to thereby decrease or increase the spring force applied by coil spring 33 on the valve disc 22 since, as seen in FIG. 3, the coil spring 33 is interposed between valve disc 22 and spring seat 24. As will be discussed shortly, the motor 29 in each of the regulating valves 3 depicted in FIGS. 2 and 3 is caused to rotate under the control of the computer in the machine control desk 10 through the amplifier 42.

Figure 4:
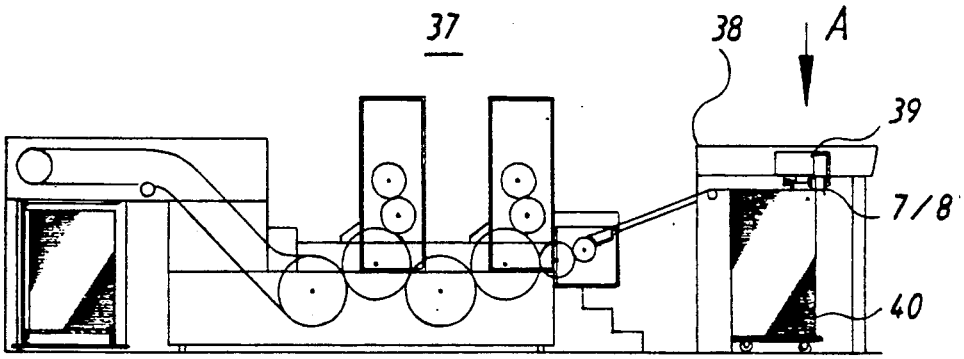
FIG. 4 is a schematic side elevation view of a sheet fed rotary press and sheet feeder utilizing a suction head in the feeder.
Figure 5:
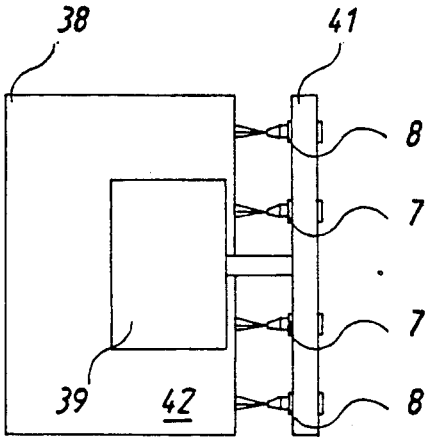
FIG. 5 is a schematic top plan view of the sheet feeder of FIG. 4 and taken in the direction indicated by arrow A in FIG. 4.

Referring now to FIGS. 4 and 5 there is shown a diagrammatic side elevation view of a sheet fed rotary printing press 37 which utilizes a sheet feeder 38 that has a suction head 39. The separating blowers 7 and the fanning blowers 8 are attached to a first crosshead 41 which is connected to a second crosshead 42 with the suction head 39. It will be understood that the separating and fanning blowers 7 and 8 are connected, as depicted in FIG. 1, through the throttles 6 and the control valves 9 to the regulating valve 3 and to the compressed air generator 1. The separating and fanning blowers 7 and 8 effect a separation of the upper sheets in a sheet pile 40, as shown in FIG. 4.

Figure 6:
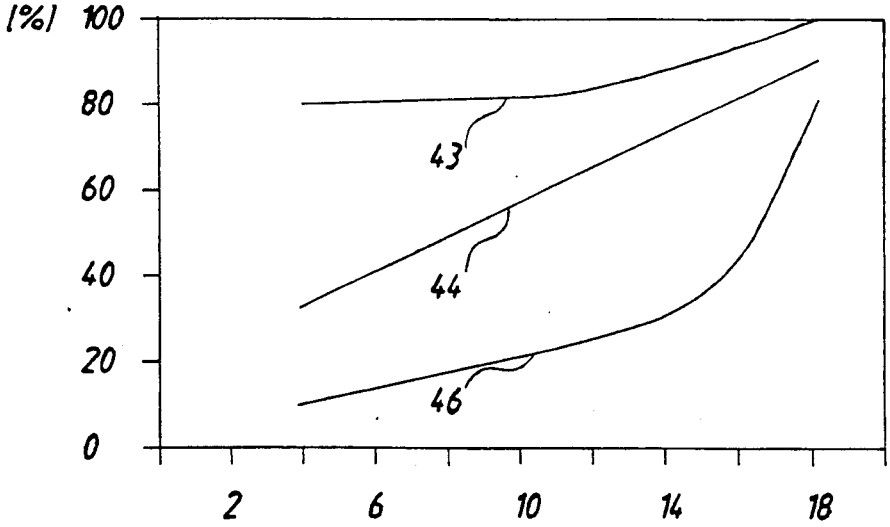
FIG. 6 is a diagrammatic representation of different characteristic curves of a regulating valve in accordance with print carrier weight and production speeds.

As was mentioned previously, the amount of compressed air required to be supplied to the separating and fanning blowers 7 and 8 to allow them to operate in their intended manner so that the sheet feeder 38 can operate effectively is a function of the weight of the sheets or other print carrier being fed, and is a function of the speed of operation of the sheet fed rotary press 37. There are shown in FIG. 6 a diagrammatic representations of three different characteristic curves for the regulating valve 3, the curves each being a function of air flow volume and production speed for a respective sheet weight. The upper curve 43 is for cardboard having a weight above 150 g/m$^2$; the middle curve 44 is for sheets having an average weight of about 70 to 90 g/m$^2$; and the lower curve 46 is for very thin paper having a weight below 40 g/m$^2$. It will be understood that there are other characteristic curves for different sheet weights which are not depicted here. The upper curve, for example indicates that regulating valve 3 must allow 89 per cent of the entire volume flow generated by the compressed air generator to pass to separating and fanning blowers 7 and 8 when the sheet feeder 38 is operating at a production speed of 14,000 sheets/hour.

The operation of the separating jet blast air control assembly in accordance with the present invention will now be discussed. The blast air duct 19 of the regulating valve assembly 3 of either FIGS. 2 or 3 receives blast air from the compressed air generator 1 through the tube 2. This compressed air is then supplied to the separating and fanning blowers 7 and 8 in accordance with the amount required by production conditions and as controlled by the regulating valve 3. In the regulating valve 3 shown in FIG. 2, the inner worm or coil spring 23 is pressed against the valve disc 22 with an initial force by rotating the handwheel 16 in the appropriate direction as indicated by arrow K. This initial force applied by inner spring 23 seats the valve disc 72 against the valve seat 21 and closes the air supply opening 18. This initial or preset load applied by the inner spring 23 is determined so that it corresponds to the air requirement of the separating and fanning blowers 7 and 8 during start-up. If the compressed air supplied to the blast air duct 19 in the direction of travel, as indicated by the arrows I in FIG. 2, increases above the preset level, the valve disc 22 will be elevated off the valve seat 21 and the excess air will travel in the direction indicated by arrows J. This will take it into the housing 11 where it will pass through exhaust openings 17 either directly into the atmosphere or into suitable absorption devices, as discussed previously.

As the sheet feeder 38 increases in operating speed and as a result of the varying air requirement of the separating blowers 7 and fanning blowers 8 which are provided with blast air in an alternating manner through the control valves 9, it becomes necessary to increase the volume of air that can pass through the blast air duct 19 without unseating the valve disc 22. This is accomplished, in the regulating valve depicted in FIG. 2 by operating motor 29 to rotate the toothed wheel 28 to turn the toothed wheel 27 on the threaded sleeve 12 so that the outer coil spring 30 will be further compressed and will thus exert a greater seating force on the valve disc 22. The motor 29 is operated in response to a control signal L generated by the computer of the machine control desk 10.

Turning again to FIG. 1 the controller output L to the motor 29 in the regulating valve 3 is used to move the toothed wheel 27 either up or down in direction H to adjust the spring force exerted by spring 30. The keypad 47 that is connected to the computer of the machine control desk 10 is used to enter various production data figures into the computer. These are figures such as production speed in sheets/hour, as well as information regarding the kind and weight of the material to be printed. This weight will be entered in grams per square meter. Using this information, the computer arrives at a control signal that is used to operate the motor 29 in the regulating valve 3. The actual air flow in the output line 4 from the regulating valve 3 is sensed by the pressure sensor 5 and this valve is returned to the computer where it is compared with the desired nominal valve. Using the appropriate characteristic curves 43 to 46 the values are compared and adjusted until the actual condition is equal to the nominal condition. The computer of the machine control desk also evaluates the actual production speed condition that is signalled by a speed sensor 15 which is positioned on the machine drive. This speed signal is designated in FIG. 1 as input M.

If there is a high air requirement, as discussed above, the motor is operated to increase the spring force applied by the spring 30 against the valve disc 22. If, on the other hand, the air requirement is reduced, the motor 29 is operated in the reverse direction to lessen or eliminate the spring force applied against the valve disc 22 by the outer spring 30. As this spring force is reduced, the valve disc 22 will become further unseated from the valve seat 21 and will allow more air to be dumped or bled off through the exhaust openings 17.

In the second preferred embodiment of the regulating valve 3 that is depicted in FIG. 3, the overall principle of operation is similar to that discussed with respect to FIG. 2. In this second preferred device, the spring force applied by the single coil spring 33 is preset by rotation of handwheel 16 in either direction, as indicated at K, while holding bushing 32 stationary. This results in movement of the spring seat 24 with respect to the valve disc 22. Further adjustments are accomplished by providing the controller output L to the motor 29 in a manner the same as that discussed in conjunction to FIG. 2. In this second embodiment, rotation of motor 29 turns the toothed wheel 28 which rotates the toothed wheel 34 on the bushing 32. The bushing 32 thus rotates in the threaded tapped hole 31 and moves the spindle 14 and its spring seat 24 up or down to vary the spring force applied to the valve disc 22 by the single coil or worm spring 33.

While a motor 29 has been depicted in FIGS. 2 and 3 as the means for moving the spring 30 or 33, respectively, it would be possible to utilize other devices. A pneumatic cylinder with a proportioned valve could be used to vary the spacing between the spring seat 24 and the valve disc 22 in either regulating valve 3. It would also be possible, in accordance with the present invention, to eliminate the first adjusting device 16 shown in FIG. 3 and to transfer the signals K and L by means of the second adjusting device 29. It will be recalled that these signals K and L, which represent the present value of the spring and the motor control adjustments, respectively, are provided by the computer of the machine control desk of the rotary press.

As was discussed above, the information regarding the material to be printed can be entered into the computer 10 via the keyboard 47 or some other input device such as, for example, a magnetic card that can be introduced into the input device. Other suitable value detecting devices can also be used.

Figure 7:
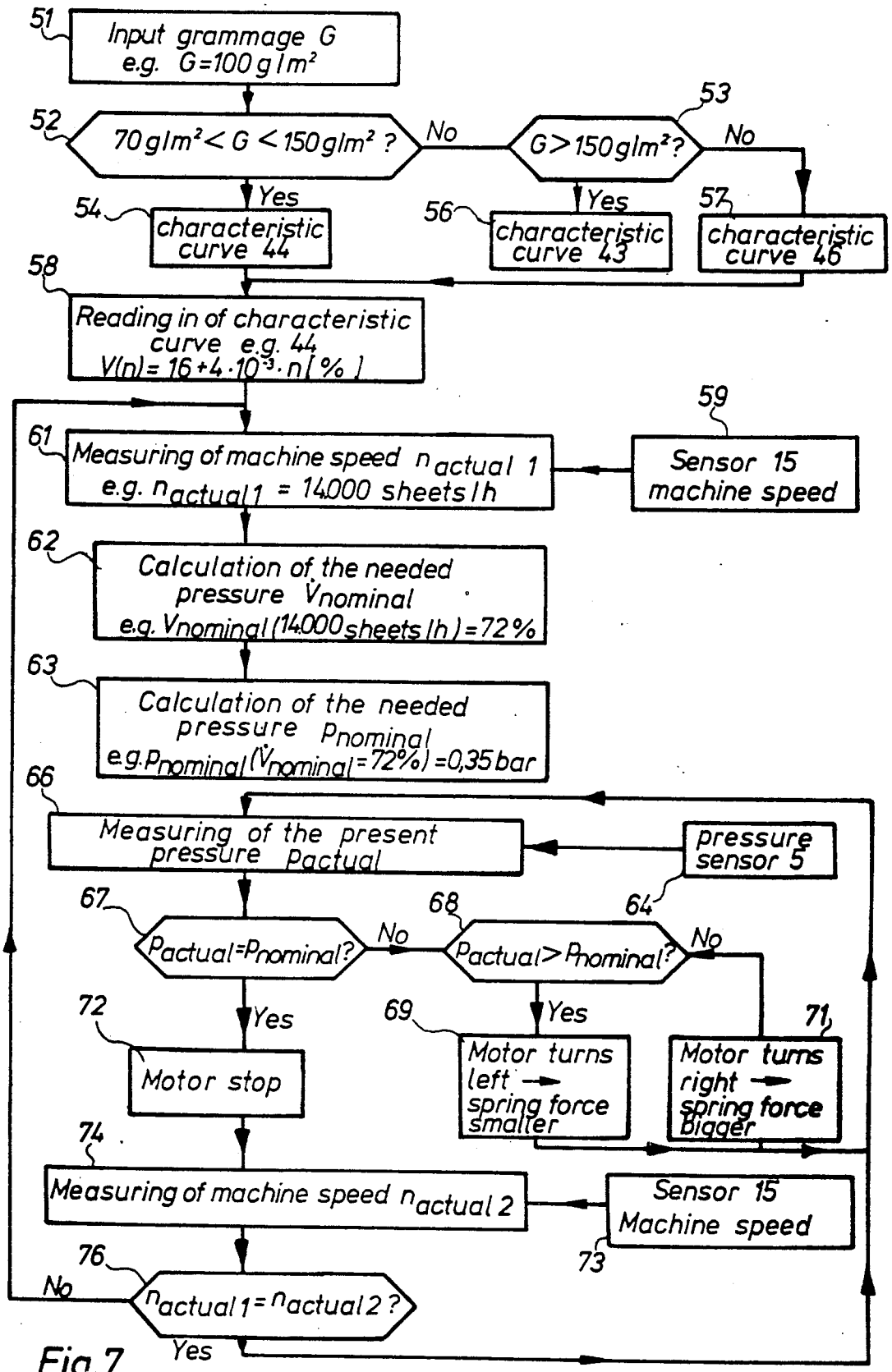
FIG. 7 is a flow diagram representing the control function of the machine control computer.

The computer 10 then responds to the various inputs to produce the appropriate output control signals. The computer operates automatically in accordance with the flow diagram illustrated in FIG. 7, to which reference is now made.

To operate the control system, after the characteristic curves such as curves 43, 44 and 46 (or the corresponding functions) have been entered, the weight (in grams) of the material to be printed is entered into the computer at step 51. The input weight is classified, in accordance with steps 52 and 53, to select the appropriate one of characteristic curves 44, 43, or 46 at steps 54, 56 and 57, respectively. The selected curve is read at step 58. As noted, the curve can be in the form of discrete values or in the form of a function. For example, curve 44 may be selected, and that curve can have either discrete values or can have a function such as $V(n)=16+4\times10^{-3}\,n$ [%].

As step 59, the sensor 15 delivers signals from which the machine speed is determined at step 61. Using the actual value of machine speed ($n_{actual\,1}$), the necessary air volume flow ($V_{nominal}$) is calculated in step 62. Step 63 calculates the necessary pressure ($P_{nominal}$) in accordance with the required volume flow ($V_{nominal}$) calculated in step 62.

The pressure sensor 5 produces a signal at step 64 which is used at step 66 to determine the actual pressure ($P_{actual}$) of the air pressure at the outlet of valve assembly 3, and the value is compared at step 67 and 68 to the desired nominal pressure ($P_{nominal}$) calculated at step 63. If the actual pressure ($P_{actual}$) is greater than the nominal pressure ($P_{nominal}$), the valve drive motor responds at step 69 to drive the valve assembly in a way to reduce the spring pressure and to bleed off additional air pressure. On the other hand, if the actual pressure is not greater than the nominal pressure, the valve drive motor rotates in the opposite direction at step 71 to reduce the bleed-off and increase the air pressure. The actual pressure is repeatedly determined at step 66 and the valve drive motor is adjusted at steps 68, 69 and 71 in a continuing loop until the measured value equals the nominal value at step 67.

When the pressure balancing loop has been completed, the current machine speed ($n_{actual\,2}$) is checked in steps 73 and 74. When the machine speed does not change in response to the foregoing, that means that $n_{actual\,1}=n_{actual\,2}$, and the pressure balancing loop (steps 66 to 72) is passed. Otherwise, the required volume flow loop and the pressure balancing loops (steps 61 to 72) are repeated.

While a preferred embodiment of a separating jet blast air control assembly in accordance with the present invention has been set forth fully and completely hereinabove, it will be apparent to one of skill in the art that a number of changes in, for example the type of sheet fed rotary printing press used, the type of compressed air generator, the number of separating and fanning blowers and the like may be made without departing from the true spirit and scope of the present invention which is accordingly to be limited only by the following claims.

What is claimed is:

1. A separating jet blast air control assembly useable to control a blast air requirement of separating air jets in a sheet feeder of a sheet fed rotary press, said separating jet blast air control assembly comprising:

a blast air generator for providing compressed air;

at least a first blast air consumer for receiving said compressed air from said blast air generator and for consuming said compressed air in a sheet feeder.

a regulating valve assembly positioned intermediate, and in fluid communication with, said blast air generator and said at least first blast air consumer;

means for sensing a pressure level of said compressed air intermediate said regulating valve assembly and said at least first blast air consumer;

means for sensing a speed of operation of the sheet feeder; and means for controlling said regulating valve assembly in accordance with said sensed pressure level and said sensed speed of operation of said sheet feeder and in accordance with characteristic curves for a kind of sheet being fed in the sheet feeder to control said pressure level of said compressed air passing through said regulating valve assembly and supplied to said at least first blast air consumer.

2. The separating jet blast air control assembly of claim 1 wherein said regulating valve assembly includes a valve disc which is operable to discharge excess compressed air supplied to said regulating valve assembly from said blast air generator, said valve disc being disposed in an air supply opening in a housing for receiving said excess compressed air, said valve disc being biased to a closed position by first and second adjusting means having first and second biasing springs.

3. The separating jet blast air control assembly of claim 2 wherein said first adjusting means is a threaded spindle that passes through a tapped hole in said housing. said threaded spindle having a first spring seat for engagement with said first biasing spring.

4. The separating jet blast air control assembly of claim 3 wherein said second adjusting means includes a second spring seat for engagement with said second biasing spring, said second spring seat being rotatably supported on a threaded sleeve carried in said housing and being rotatable by a motor.

5. The separating jet blast air control assembly of claim 1 wherein said regulating valve assembly includes a valve disc which is operable to discharge excess compressed air supplied to said regulating valve assembly from said blast air generator, said valve disc being disposed in an air supply opening in a housing for receiving said excess compressed air, said valve disc being biased to a closed position by first and second adjusting means having a biasing spring.

6. The separating jet blast air control assembly of claim 5 wherein said first adjusting means is a threaded spindle which is received in a threaded bushing that is carried in said housing, said threaded spindle having a spring seat which engages said biasing spring.

7. The separating jet blast air control assembly of claim 6 wherein said second adjusting means is a gear on said threaded bushing and a motor driven gear wheel which engages said gear on said bushing whereby said bushing and said spindle may be adjusted.

8. The separating jet blast air control assembly of claim 3 wherein said threaded spindle has a handwheel.

9. The separating jet blast air control assembly of claim 6 wherein said threaded spindle has a handwheel.

* * * * *